US006651837B2

(12) United States Patent
Stradinger et al.

(10) Patent No.: US 6,651,837 B2
(45) **Date of Patent: *Nov. 25, 2003**

(54) VACUUM WASTE TANK

(75) Inventors: Jay D. Stradinger, Roscoe, IL (US); Mark A. Pondelick, Brodhead, WI (US)

(73) Assignee: Evac International Oy, Helsinki (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 24 days.

(21) Appl. No.: 09/296,139

(22) Filed: Apr. 21, 1999

(65) Prior Publication Data

US 2001/0002023 A1 May 31, 2001

(51) Int. Cl.[7] ..... B65D 25/00
(52) U.S. Cl. ..... 220/661; 220/4.13
(58) Field of Search ..... 220/661, 4.05, 220/4.07, 4.09, 4.13, 4.26, 4.16, 646, 648, 654, 669, 672, 567.1; 4/321

(56) References Cited

U.S. PATENT DOCUMENTS

| | | | | |
|---|---|---|---|---|
| 4,171,853 A | | 10/1979 | Cleaver et al. | |
| 4,865,631 A | | 9/1989 | Stroby et al. | |
| 4,911,326 A | * | 3/1990 | McGouran, Jr. | 220/567.1 |
| 5,002,592 A | | 3/1991 | Stroby et al. | |
| 5,017,044 A | * | 5/1991 | Sharp | 220/4.13 X |
| 5,133,475 A | * | 7/1992 | Sharp | 220/648 X |
| 5,234,286 A | * | 8/1993 | Wagner | 220/4.13 X |
| 5,320,247 A | * | 6/1994 | Sharp | 220/654 |
| 5,621,924 A | * | 4/1997 | Friedman et al. | 4/321 X |
| 5,806,702 A | * | 9/1998 | Sabo | 220/4.13 X |

* cited by examiner

*Primary Examiner*—Steven Pollard
(74) *Attorney, Agent, or Firm*—Marshall, Gerstein & Borun

(57) ABSTRACT

A vacuum waste tank for use in a vacuum drainage system. The tank has a vacuum intake for attachment to a vacuum source and a waste water intake for attachment to a vacuum pipe. The vacuum source creates a negative pressure in the tank and vacuum pipe so that liquid entering the pipe is pulled into the tank. The tank is made of a thermoplastic material having a flexural modulus sufficient to withstand an external pressure loading caused by the vacuum in the tank without buckling.

15 Claims, 1 Drawing Sheet

VACUUM WASTE TANK

FIELD OF THE INVENTION

The present invention generally relates to tanks for collecting waste liquid, and more particularly to collection tanks used in vacuum drainage systems.

BACKGROUND OF THE INVENTION

Health and Environmental agencies require waste water to be collected and directed to a proper receptacle, such as a municipal sewer or private septic tank. The term "waste water" as used herein includes used or dirty process water (known as gray water), and sewage water (commonly referred to as black water). Gray water may be generated from a variety of different operations. In a grocery store, for example, water is used in deli, food service, and floral departments for cleaning, maintenance, and other purposes. Refrigerated display cases generate additional process water from condensate and defrost procedures. The waste water generated from these various sources must be collected and transported to the proper receptacle.

In the past, conventional gravity drainage piping has been used to collect and transport waste water. Gravity drainage systems use collection points located below the waste water source which feed into drainage pipes leading to a sewer line. The piping in such systems must be continuously sloped so that the waste water flows all the way to the sewer line. As a result, pipes for gravity drainage systems are often laid in or underneath the concrete pad supporting the facility. This process not only requires significant amounts of additional plumbing work, but also complicates changes in facility layout, which would require portions of the concrete pad to be ripped up to expose drainage channels.

More recently, vacuum drainage systems have been used to collect and transport waste water. A vacuum drainage system typically comprises a collection drain located under each waste water source, each collection drain leading to a common drain pipe. The drain pipe is connected to a collection tank which is in fluid communication with a pump. The pump creates negative pressure in the tank and drain pipe to thereby pull liquid through the drain pipe and into the tank. The tank has a drain that is typically positioned over a sewer line to allow the tank to be emptied.

It will be appreciated that the tanks used in vacuum drainage systems must be large enough to hold a substantial volume of liquid while withstanding a continuous external pressure without buckling. For example, collection tanks are typically sized to house approximately 20–100 gallons of liquid. The side walls of such tanks are often cylindrical, and have a diameter of approximately 17 to 60". Furthermore, conventional vacuum drainage systems often generate continuous negative pressures of up to 25" Hg or more.

As a result, previous tanks used in vacuum drainage systems have been formed of steel. Steel tanks, however, are overly costly to fabricate. In addition, steel is overly heavy for certain tank applications. Furthermore, steel quickly conducts outside temperature to the liquid contained therein and, therefore, is not suitable for certain applications in which the stored liquid is intended to maintain an elevated temperature. Still further, steel requires expensive treatment to resist corrosion or the life of the tank will be significantly shortened.

SUMMARY OF THE INVENTION

In accordance with certain aspects of the present invention, a vacuum waste tank is provided for use in a vacuum drainage system having a vacuum drainage pipe and a vacuum source fluidly communicating with the tank. The tank comprises a cylindrical side wall, first and second end caps attached to opposite ends of the side wall to form an enclosed chamber, a vacuum intake adapted for fluid communication with the vacuum source, and a drain outlet. The side wall and end caps are formed of a thermoplastic material having a flexural modulus of at least 175,000 psi.

The side wall of the tank may be formed with ribs projecting substantially outwardly. The ribs may be formed to resist buckling under an external pressure load on the tank of 25" Hg. In that regard, the ribs preferably have a substantially rectangular cross-section formed by radially outwardly extending upper and lower flanges connected at outside edges by a cylindrical side member. The tank may have a diameter of approximately 17 to 28 inches. In a most preferred embodiment, the thermoplastic material is polypropylene.

In accordance with additional aspects of the present invention, a vacuum waste tank is provided comprising a cylindrical side wall, first and second end caps attached to opposite ends of the side wall to form an enclosed chamber, a vacuum intake, a waste water intake, a drain, and a plurality of ribs extending about a circumference of the side wall and spaced along a length of the side wall by a spaced distance. The side wall and end caps are formed of a thermoplastic material capable of resisting a continuous external pressure loading resulting from a negative pressure in the chamber of approximately 10 to 25 inches Hg.

Other features and advantages are inherent in the apparatus claimed and disclosed or will become apparent to those skilled in the art from the following detailed description and its accompanying drawings.

DETAILED DESCRIPTION OF THE PREFERRED EMBODIMENTS

Figure 1:
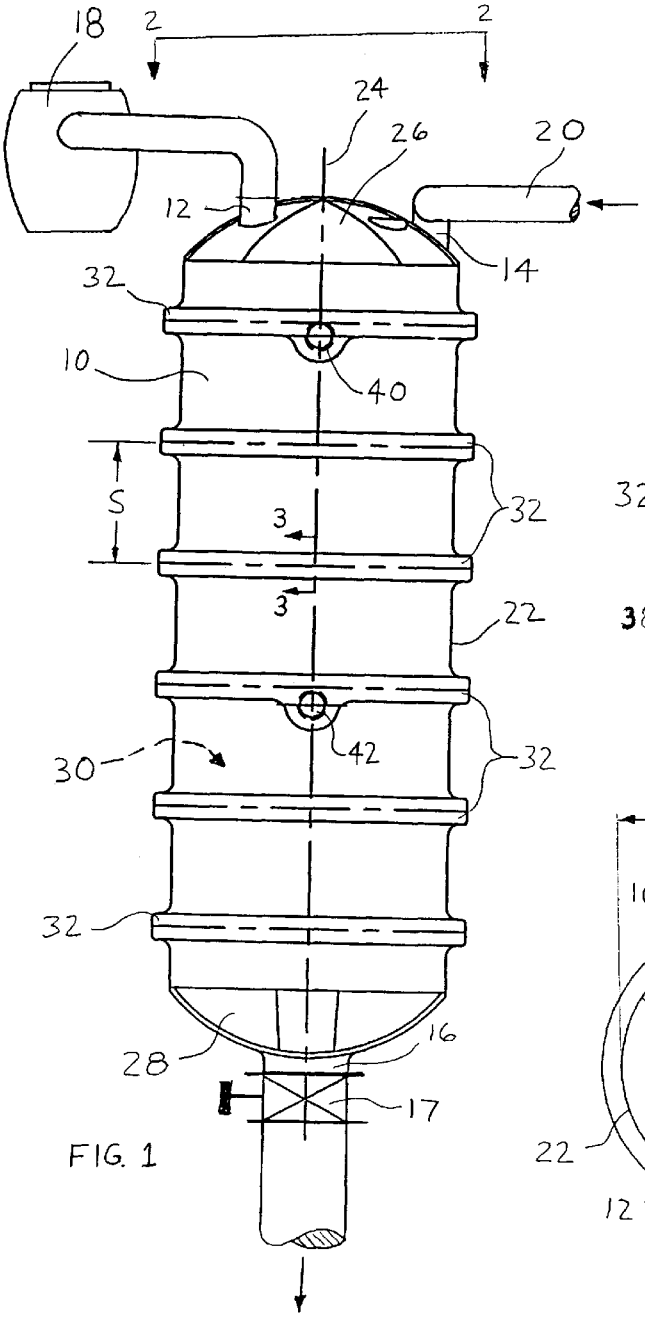
FIG. 1 is a side elevation view of a tank constructed in accordance with the teachings of the present invention.

A tank 10 in accordance with the teachings of the present invention is illustrated in FIG. 1. The tank 10 includes a vacuum intake 12, a waste water intake 14, and a drain 16. The tank of FIG. 1 is installed in a vacuum drainage system comprising a pump 18 connected to the vacuum intake 12 and a vacuum pipe 20 connected to the waste water intake 14. The vacuum pipe 20 has an opposite end connected to one or more branches (not shown) for collecting waste water, such as used process water or sewage. The pump 18 creates negative pressure in the tank 10 and vacuum pipe 20 thereby to pull the liquid collecting in the branches through the vacuum pipe 20 and into the tank 10. The drain 16 has a valve 17 which controls access to a sewer system (not shown). When the valve 17 is open, the contents of the tank are discharged into the sewer line thereby to empty the tank. It will be appreciated, however, that the tank may be mounted in a mobile application, such as a train or a boat, in which the drain 16 is not permanently connected to the sewer but instead the valve closes off the drain until the tank can be positioned where it may be emptied into the appropriate receptacle.

In the currently preferred embodiment, the tank 10 comprises a cylindrical side wall 22 disposed about a substantially vertical axis 24. Upper and lower end caps 26, 28 are attached to upper and lower ends of the side wall 22 to form an enclosed chamber 30 for holding liquid. The end caps 26, 28 are preferably formed in a semi-spherical shape, as illustrated in FIG. 1. The end caps 26, 28 may be separately formed or may be integral with the side wall 22. In a vertically oriented tank, the vacuum and waste water intakes 12, 14 are preferably formed in the upper end cap 26 to maximize the usable volume of the tank 10. The drain 16 is preferably formed in the lower end cap 28 so that the entire contents of the tank 10 may be drained as needed. The tank 10 is sized to house a volume of liquid on the order of 20–100 gallons. Accordingly, the side wall 22 must have a relatively large diameter "D" (FIG. 2) which is approximately 14 to 28 inches.

The side wall 22 preferably has upper and lower sensor ports 40, 42. The sensor ports 40, 42 accept sensors (not shown) which provide feedback regarding liquid level in the tank 10. For example, the sensors may indicate when certain liquid levels are reached in the tank 10 thereby to trigger a controller (not shown) to open the drain 17. The sensor ports 40, 42 are preferably formed integrally with the side wall 22.

In accordance with certain aspects of the present invention, the tank 10 is formed of a thermoplastic material. The thermoplastic material must be suitable for use in vacuum drainage systems which generate continuous negative pressure of at least 25" Hg inside the tank. A continuous pressure of this magnitude often causes thermoplastic materials to creep over time. The thermoplastic material, therefore, must be sufficiently stiff to overcome the creep factor while resisting buckling. The material must also be capable of being formed into tanks having relatively large volumes (with relatively large diameters). Accordingly, it has been found that materials exhibiting sufficient stiffness, such as those having a flexural modulus of at least 175,000 psi, may be used to form a vacuum waste tank used in a vacuum drainage system. In addition, because the tank 10 is used to collect liquid, the material must be sufficiently non-absorbent, particularly with respect to water. The material also preferably cleans easily, which is particularly beneficial for applications involving sewage. It is further advantageous for the material to insulate the liquid from temperatures outside of the tank 10. Such insulation is particularly desirable when the tank 10 is located in a cold environment and the waste liquid collected in the tank 10 has an elevated temperature or is otherwise susceptible to freezing. Still further, the material is preferably corrosion resistant.

In light of the above desired properties, it has been found that polypropylene with a flexural modulus greater than 175,000 psi is a preferred material for the tank 10. Polypropylene is easy to clean and also exhibits insulating qualities which serve to maintain the temperature of the waste liquid longer than a steel tank. Polypropylene is corrosion resistant and therefore has a long life, even when subjected to water. In addition, cylindrical tanks made of polypropylene may be formed using rotational molding, which is less expensive and results in tanks having substantially uniform wall thickness. Nylon material may also be rotationally molded and has sufficient stiffness, but is a less desirable alternative because it absorbs water and is relatively more expensive. Materials other than polypropylene and nylon which have previously been used in the rotational molding process, while typically less expensive than polypropylene, do not have sufficient stiffness for use in a vacuum drainage system.

Figure 2:
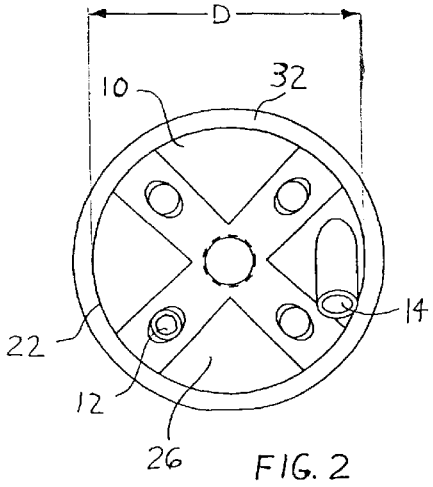
FIG. 2 is a top view of the tank taken along line 2—2 of FIG. 1.

It will be appreciated that the tank 10 may be formed with a variety of diameters and lengths. For any particular size, it has been determined that a wall thickness of at least 0.4" is preferred to provide adequate stiffness to the tank 10. Depending on the ratio of tank length over tank diameter (or L/D ratio), ribs 32 may be needed to provide additional stiffness. As used herein, tank length is height of the cylinder formed by the side wall 22, not including the end caps 26, 28. For tanks having an L/D ratio less than 1, ribs are not needed, since side wall thickness may be increased if necessary without significantly increasing cost of the tank. For tanks having an L/D ratio greater than 1, ribs 32 are needed to economically increase the stiffness of the tank 10. The ribs 32 are formed as annular projections which extend about the circumference of the side wall 22 (FIGS. 1 and 2). The ribs 32 are formed along the length of the side wall 22 at spaced distances "S". The spaced distance "S" is preferably approximately 7 to 12 inches.

Figure 4:
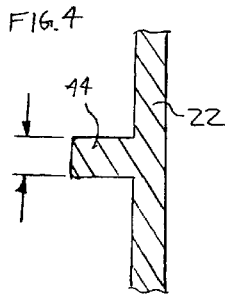
FIG. 4 is a side elevation view, in cross-section, of an alternative embodiment of the tank having solid ribs.
Figure 3:
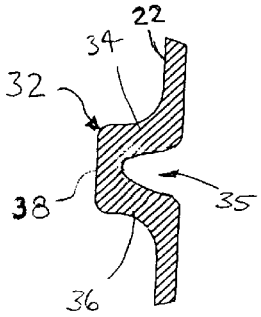
FIG. 3 is a side elevation view, in cross-section, of the tank taken along line 3—3 of FIG. 1.

Each rib 32 is shaped to resist buckling due to the external pressure loading created by the vacuum inside the tank 10. In the currently preferred embodiment illustrated in FIG. 3, each rib 32 is hollow and has a generally rectangular shape created by upper and lower flanges 34, 36 which project radially outwardly from the side wall 22. A cylindrical side member 38 extends between outer edges of the upper and lower flanges 34, 36 to complete the rib 32. The upper flange 34, lower flange 36, and side member 38 form a rib 32 which extends about the periphery of the side wall 22 and has a generally rectangular cross-section defining an annular recess 35. In the alternative, solid ribs 44 may be used, as shown in FIG. 4. According to the illustrated embodiment, the solid ribs 44 also have a generally rectangular cross-section, but do not have a recess. When used on a tank of the same size, the solid ribs 44 may have a width "W" that is less than the width of a corresponding hollow rib. In fact, it has been found that the width "W" of the solid ribs 44 may be as little as ½ the width of hollow ribs. It will further be appreciated that the ribs, whether hollow or solid, may be formed in other cross-sectional shapes without departing from the spirit or scope of the present invention.

From the foregoing, it will be appreciated that the present invention brings to the art an improved vacuum waste tank for use in a vacuum drainage system. The tank is formed of a thermoplastic material having sufficient stiffness to resist external loading created by a vacuum in the tank. More specifically, the plastic material withstands constant negative pressures of 10 to 25 inches Hg without buckling. The tank may have ribs which serve to further stiffen the tank against buckling. A preferred material is polypropylene.

The foregoing detailed description has been given for clearness of understanding only, and no unnecessary limitations should be understood therefrom, as modifications would be obvious to those skilled in the art. The tank has a vacuum intake for attachment to a vacuum source and a waste water intake for attachment to a vacuum pipe. The vacuum source creates a negative pressure in the tank and vacuum pipe so that liquid entering the pipe is pulled into the tank. The tank is made of a thermoplastic material having a flexural modulus sufficient to withstand an external pressure loading caused by the vacuum in the tank without buckling. The thermoplastic tank is less expensive, lighter, exhibits better insulating qualities, and has superior corrosion resistance than a steel tank.

What is claimed is:

1. A vacuum waste tank for use in a vacuum drainage system having a vacuum drainage pipe and a vacuum source capable of generating a vacuum level of at least approximately 10 to 25 inches Hg fluidly communicating with the tank, the tank comprising:

a cylindrical side wall disposed about an axis; and first and second end caps attached to opposite ends of the side wall to form an air-tight chamber, a vacuum intake formed in the chamber adapted for fluid communication with the vacuum source, wherein the side wall, first end cap, and second end cap comprise a thermoplastic material having a flexural modulus of at least 175,000 psi and a thickness of at least 0.4 inches.

2. The vacuum waste tank of claim 1, in which the side wall further comprises radially outwardly projecting ribs positioned at spaced locations.

3. The vacuum waste tank of claim 2, in which each rib has a cross-section shaped to resist buckling under an external pressure loading on the tank.

4. The vacuum waste tank of claim 3, in which each rib is hollow and has a substantially rectangular cross-section formed by radially outwardly extending upper and lower flanges connected at outside edges by a cylindrical side member.

5. The vacuum waste tank of claim 1, in which the side wall has a diameter of approximately 17 to 28 inches.

6. The vacuum waste tank of claim 1, in which the thermoplastic material is substantially non-absorbent.

7. The vacuum waste tank of claim 6, in which the thermoplastic material is polypropylene.

8. A vacuum waste tank comprising:

a cylindrical side wall;

first and second end caps attached to opposite ends of the side wall to form an air-tight chamber;

a vacuum intake formed in the chamber;

a waste water intake formed in the chamber;

a drain formed in the chamber; and a plurality of ribs extending about a circumference of the side wall and spaced along a length of the side wall by a space distance;

wherein the side wall and end caps are formed of a thermoplastic material having a flexural modulus of at least 175,000 psi and a thickness of at least 0.4", the chamber thereby being capable of resisting a continuous external pressure loading resulting from a negative pressure in the chamber of approximately 10 to 25 inches Hg.

9. The vacuum waste tank of claim 8, in which the space distance is approximately 7 to 12 inches.

10. The vacuum waste tank of claim 8, in which each rib has a cross-section shaped to resist buckling under an external pressure loading on the tank.

11. The vacuum waste tank of claim 10, in which each rib is hollow and has a substantially rectangular cross-section formed by radially outwardly extending upper and lower flanges connected at outside edges by a cylindrical side member.

12. The vacuum waste tank of claim 11, in which the ribs are formed integrally with the side wall.

13. The vacuum waste tank of claim 8, in which the thermoplastic material in substantially non-absorbent.

14. The vacuum waste tank of claim 8, in which the thermoplastic material is polypropylene.

15. The vacuum waste tank of claim 14, in which the side wall has a diameter of approximately 17 to 28 inches.

* * * * *

UNITED STATES PATENT AND TRADEMARK OFFICE

CERTIFICATE OF CORRECTION

PATENT NO. : 6,651,837 B2 
DATED : November 25, 2003
INVENTOR(S) : Jay D. Stradinger et al.

It is certified that error appears in the above-identified patent and that said Letters Patent is hereby corrected as shown below:

Column 5,
Line 8, please delete "source," and insert -- source; --.

Signed and Sealed this

Third Day of February, 2004

JON W. DUDAS
*Acting Director of the United States Patent and Trademark Office*